US005913735A

United States Patent [19]

Kenmi

[11] Patent Number: 5,913,735

[45] Date of Patent: Jun. 22, 1999

[54] METALLIC GOLF CLUB HEAD HAVING A WEIGHT AND METHOD OF MANUFACTURING THE SAME

[75] Inventor: Yoshinari Kenmi, Kobeshi, Japan

[73] Assignee: Royal Collection Incorporated, Kobeshi, Japan

[21] Appl. No.: 09/123,980

[22] Filed: Jul. 29, 1998

[30] Foreign Application Priority Data

Nov. 14, 1997 [JP] Japan ..... 9-313842

[51] Int. Cl.[6] ..... A63B 53/04

[52] U.S. Cl. ..... 473/338; 473/345; 473/349; 29/447

[58] Field of Search ..... 473/324, 334, 473/335, 338, 341, 345, 349, 350; 29/447, DIG. 48

[56] References Cited

U.S. PATENT DOCUMENTS

| | | | |
|---|---|---|---|
| 4,180,269 | 12/1979 | Thompson | 473/334 |
| 4,630,825 | 12/1986 | Schmidt | 473/338 |
| 4,714,252 | 12/1987 | Roraback | 473/341 |
| 5,193,811 | 3/1993 | Okumoto | 473/324 |
| 5,294,037 | 3/1994 | Schmidt | 228/125 |
| 5,421,577 | 6/1995 | Kobayashi | 473/334 |
| 5,774,970 | 7/1998 | Huang | 29/447 |

FOREIGN PATENT DOCUMENTS 6-296716 10/1994 Japan .

*Primary Examiner*—Kien T. Nguyen
*Attorney, Agent, or Firm*—Armstrong, Westerman Hattori, McLeland & Naughton

[57] ABSTRACT

A golf club head includes a hollow head body having a bottom opening and a sole member welded to the hollow head body, both of which are made of titanium or titanium alloy. An upwardly-opened weight-fitting concave portion is formed on an inner surface of the sole member. A protrusion is formed on the inner surface of the concave portion. A weight made of a metallic material such as brass is formed. The weight is forcibly fitted into the concave portion and the protrusion of the concave portion is forcibly inserted in the bottom surface of the weight, whereby the weight is fixed in the concave portion. Then, the sole member with the weight is welded to the hollow head body.

11 Claims, 4 Drawing Sheets

PRIOR ART

METALLIC GOLF CLUB HEAD HAVING A WEIGHT AND METHOD OF MANUFACTURING THE SAME

BACKGROUND OF THE INVENTION

1. Field of the Invention

This invention relates to a metallic golf club head and, more particularly, to a metallic golf club head having a hollow head body and a sole member with a weight, and further relates to a method of manufacturing the same.

2. Description of the Related Art

Recently, a metallic golf club head made of titanium or titanium alloy (hereinafter referred to as "titanium") has become popular because of the following reasons: (a) titanium is high in restitution; (b) titanium is light in weight, though not as light as carbon, small in specific gravity, and high in rigidity (therefore, a golf club head made of titanium can be formed to have a large hollow head body); and (c) a weight can thus be disposed in any portion of the hollow head body to adjust the center of gravity.

However, titanium is hard to weld to a metal other than titanium. Therefore, a face member or a sole member made of a metal other than titanium can not be welded to a hollow head body made of titanium, or a weight made of a metal other than titanium can not be welded to a face member or a sole member made of titanium.

Generally, the following method of fixing a weight in a golf club head body has been adopted. As shown in FIG. 9, a plurality of holes are formed in a sole member 52, which will be welded to a hollow head body 51. A hole is formed in each weight 53. Each weight 53 is arranged on the inner surface of the sole member 52 so as to align the hole of the sole member 52 with that of the weight 53. A rivet 54 is inserted into the hole of the sole member 52 and that of the weight 53 from the sole member side. Then, the tip end of the rivet 54 is caulked so as to fix the weight 53 to the sole member 52. Finally, the sole member 52 with the weight 53 is welded to the head body 51.

Furthermore, Japanese Laid-open (unexamined) Patent Application No. H6-296716 discloses another method of fixing a weight in a golf club head body. According to this method, a hole is formed in a sole member as well as in a weight. The weight is arranged on the inner surface of the sole member. A bolt is inserted into the holes of the sole member and the weight from the sole member side. Then, the bolt is tightened by a nut so as to fix the weight to the sole member.

In both of the above-mentioned methods, rivets or bolts are used to fix a weight to a sole member. Accordingly, in addition to a process for forming a head body and a sole member, a process for boring a hole for inserting the rivet or the bolt in a weight and a sole member is required. Moreover, a plurality of processes for tightening bolts or caulking rivets are required. Therefore, it takes time for manufacturing a golf club head having a weight.

In a golf club head in which bolts and nuts are used for securing a weight, nuts may loosen with time, resulting in a wobbling weight.

SUMMARY OF THE INVENTION

The present invention was conceived to overcome the above-described problems. It is an object of the present invention to provide a metallic golf club head having a weight, wherein the weight can be easily secured to the sole member without bolts or rivets, or the like, and is firmly secured to the sole member. It is another object of the present invention to provide a method of manufacturing the same.

According to one aspect of the present invention, a metallic golf club head includes a hollow head body having a bottom opening, a sole member fitted in the bottom opening, and a weight secured to the sole member. The sole member includes an upwardly-opened weight-fitting concave portion having an inner bottom with at least one protrusion. The weight is forcibly fitted in the concave portion with the protrusion forcibly inserted in a bottom of the weight, whereby the weight is firmly fixed in the concave portion. The sole member having the weight firmly fixed thereto is fitted in the bottom opening of the head body and is welded thereto.

As mentioned above, since the weight is forcibly fitted in the concave portion of the sole member with the protrusion forcibly inserted, or anchored, in the bottom of the weight, the weight is firmly fixed to the sole member. Therefore, in the golf club head according to the present invention, the weight can be more firmly fixed to the sole member and the number of components can be reduced as compared to the conventional golf club head in which a weight is fixed to a sole member by using a bolt or a rivet. Further, the golf club head can easily be manufactured.

When the sole member is welded to the hollow head body, the welding heat causes the concave portion of the sole member to expand, which in turn may cause the weight to loosen in the concave portion. However, in the present invention, since the protrusion formed in the concave portion is forcibly inserted, i.e., anchored, in the bottom of the weight, the weight is prevented from coming out of the concave portion. In particular, even if the welding is carried out in such a state that the head body having a bottom opening is placed upside down and the sole member is fitted in the bottom opening with the weight facing down, the weight can be prevented from sliding downward or dropping into the hollow head body. Therefore, the present invention can easily provide a metallic golf club head having a weight fixed at a predetermined position.

According to another aspect of the present invention, a method of manufacturing a metallic golf club head, which includes a hollow head body having a bottom opening, a sole member fitted in the bottom opening and welded to the hollow head body, and a weight secured to the sole member, includes the steps of: preparing a sole member made of a metallic material including an upwardly-opened weight-fitting concave portion which has an inner bottom with at least one protrusion; heating the sole member to expand the concave portion; fitting the weight into the expanded concave portion and forcibly inserting the protrusion into a bottom of the weight; cooling the concave portion to shrink-fit the weight; fitting the sole member with the weight secured thereto in the bottom opening; and welding the sole member to the hollow head body.

According to this method, the number of components constituting a golf club head can be reduced and the manufacturing thereof can be performed easier than with the conventional method in which a weight is fixed to a sole member with a bolt, a rivet, or the like. Moreover, since the weight is fixed in the concave portion by a shrink fit, a weight-loosening, which may occur in a conventional golf club head having a weight secured by bolts or the like with time, can be prevented.

When the sole member is welded to the hollow head body, the concave portion of the sole member may expand due to the welding heat to cause the weight to loosen in the concave portion of the sole member. However, in the present invention, since the protrusion of the concave portion is forcibly inserted, i.e., anchored, in the bottom of the weight before welding, the weight can be certainly prevented from coming out of the concave portion. In particular, even if welding is carried out in such a state with a head body having a bottom opening placed upside down and a sole member fitted in the bottom opening with a weight faced down, the weight can be prevented from sliding downward or dropping into the hollow head body. Therefore, the present invention can easily provide a metallic golf club head having a weight fixed at a predetermined position.

Other objects and features will be apparent from the following detailed description of the embodiments with reference to the attached drawings.

DETAILED DESCRIPTION OF THE PREFERRED EMBODIMENTS

Preferred embodiments of the present invention will now be described, in detail, with reference to the accompanying drawings.

The illustrated embodiment is applied to an iron club head H.

Figure 1:
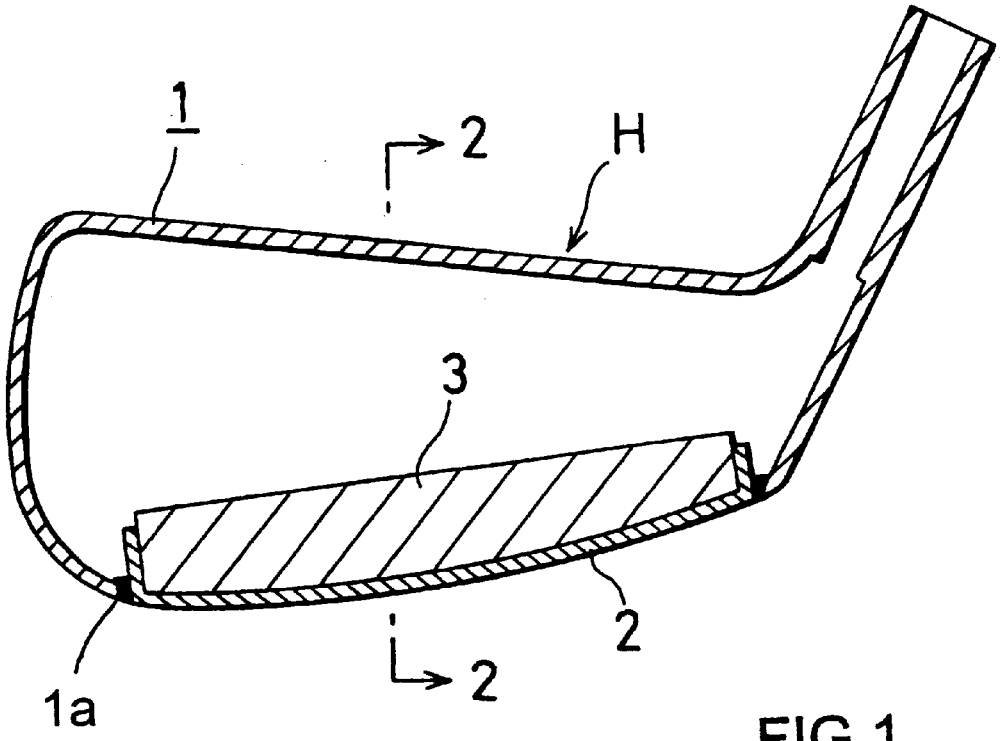
FIG. 1 is a vertical cross-sectional view of the metallic golf club head of an embodiment according to the invention.
Figure 2:
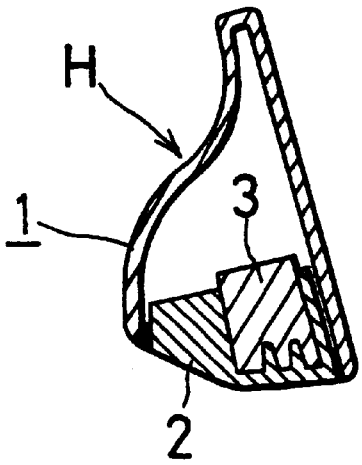
FIG. 2 is a cross-sectional view of the club head taken along the line 2—2 of FIG. 1.

As shown in FIGS. 1 and 2, the iron club head H includes a hollow head body 1, a sole member 2 and a weight 3.

The hollow head body 1 is made of titanium and has a bottom opening 1*a*.

Figure 3:
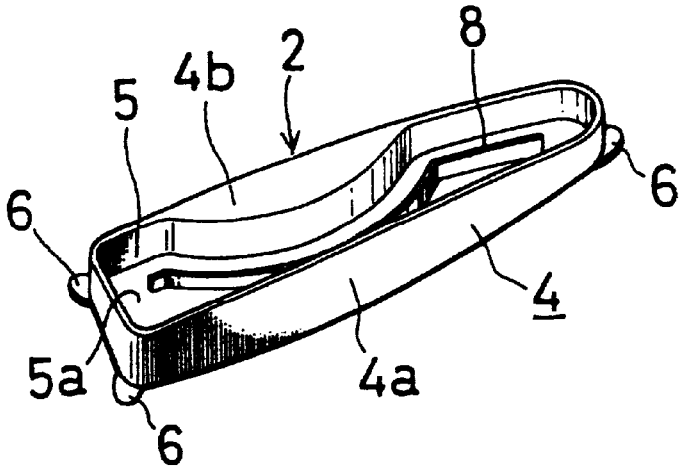
FIG. 3 is a perspective view of the sole member.
Figure 4:
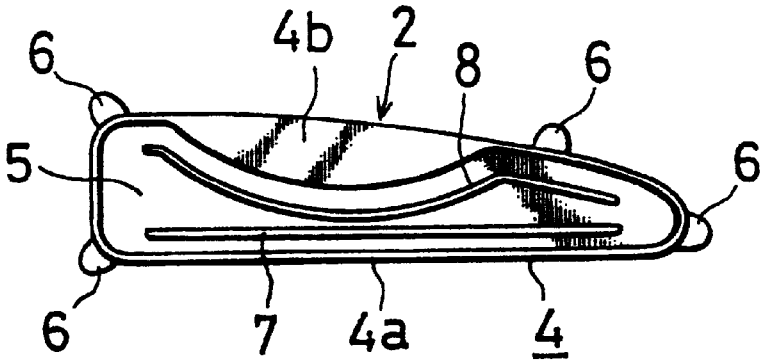
FIG. 4 is a top view of the sole member.
Figure 7:
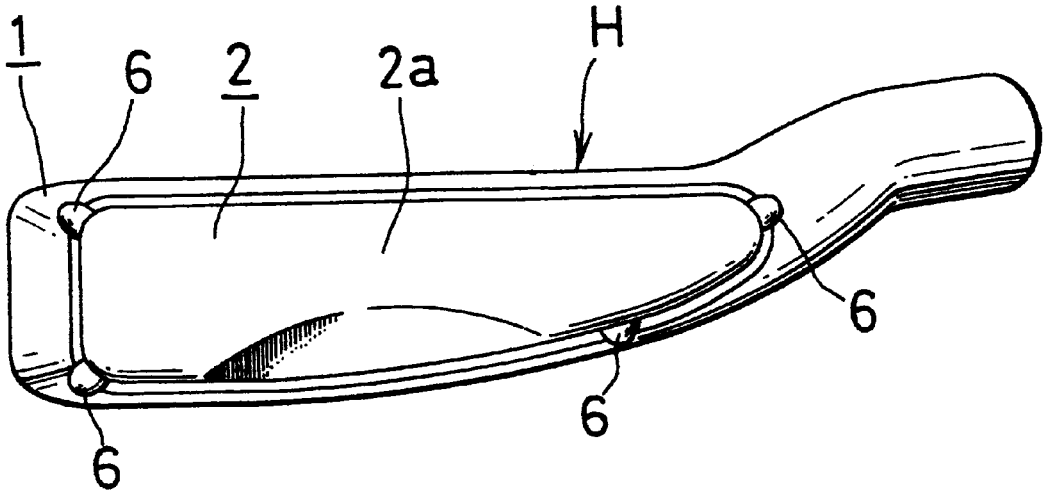
FIG. 7 is a plan view of the hollow head body which is placed upside down for welding the sole member to the head body, wherein the sole member is fitted in the bottom opening of the hollow head body.

The sole member 2 is made of titanium like the hollow head body 1. As shown in FIGS. 1 and 2, the sole member 2 has a gently-curved bottom surface. As shown in FIGS. 3 and 4, the sole member 2 has a generally boat-like shape as a whole. The sole member 2 has a peripheral wall portion 4 along the bottom peripheral edge, forming an upwardly-opened weight fitting concave portion 5. The peripheral wall portion 4 has, at its rear side, i.e., the upper side of FIG. 4, an inwardly protruded portion 4*b*. The peripheral wall portion 4 has, at its front side, i.e., the lower side of FIG. 4, a generally straight wall portion 4*a*. As shown in FIG. 7, the sole surface 2*a* of the sole member 2 is formed to have a shape corresponding to the bottom opening 1*a* of the hollow head body 1, and is formed to be slightly smaller than the bottom opening 1*a*. The sole member 2 has a plurality of tongue-shaped small pieces 6 protruding sideways from the peripheral edge of the sole portion 2*a*.

As shown in FIGS. 2 to 4, first and second wall-like protrusions 7, 8 are formed on an inner bottom surface 5*a* of the concave portion 5. A first wall-like protrusion 7 is formed to be straight and parallel to the straight peripheral wall portion 4*a*, while the second wall-like protrusion 8 is formed to have a curved shape corresponding to the inwardly protruded portion 4*b*.

Figure 5:
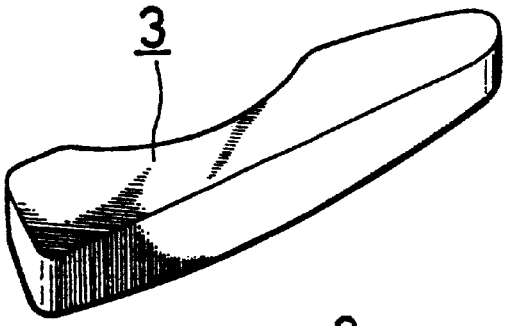
FIG. 5 is a perspective view of the weight.
Figure 6:
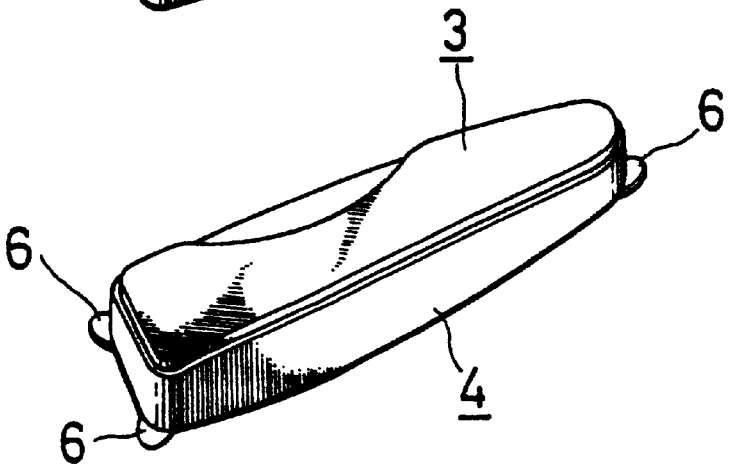
FIG. 6 is a perspective view of the sole member and the weight fitted therein.

A weight 3 is preferably made of a metallic material which is lower in hardness and larger in specific gravity than titanium. For example, a copper alloy such as brass or lead is preferable used as a material of the weight 3. As shown in FIG. 5, the weight 3 has a shape corresponding to the concave portion 5 of the sole member 2. The weight 3 is formed to be a little bit smaller in size than the concave portion 5 so as to be forcibly fitted in the concave portion 5. The height of the weight 3 is formed to be even higher than the depth of the concave portion 5 when the bottom surface of the weight 3 touches the inner bottom surface 5*a* of the concave portion 5.

Preferably, the weight 3 will be fixed to the sole member 2 as follows. The whole sole member 2 is heated to expand the concave portion 5. Then, the weight 3 is inserted into the expanded concave portion 5. It is more preferable that the weight 3 is forcibly inserted into the expanded concave portion 5. At this time, the weight 3 itself is not heated. When the weight 3 is fitted into the concave portion 5, a pressure is applied to the weight 3 so that the protrusions 7, 8 of the concave portion 5 are inserted, i.e., anchored, in the bottom surface of the weight 3. After that, the sole member 2 is cooled down. Since the sole member 2 shrinks when cooled down, the weight 3 is firmly fitted in the concave portion 5 by a shrink fit. Thus, the weight 3 is firmly fixed in the sole member 2 because not only the weight 3 is firmly fixed to the sole member 2 by a shrink fit but also the protrusions 7, 8 are anchored to the weight 3. Instead of the above-mentioned shrink fit, the weight 3 may be just forcibly fitted in the concave portion 5 of the sole member 2.

The reason why the protrusions 7, 8 are inserted, or anchored, in the weight 3, is as follows.

Figure 8:
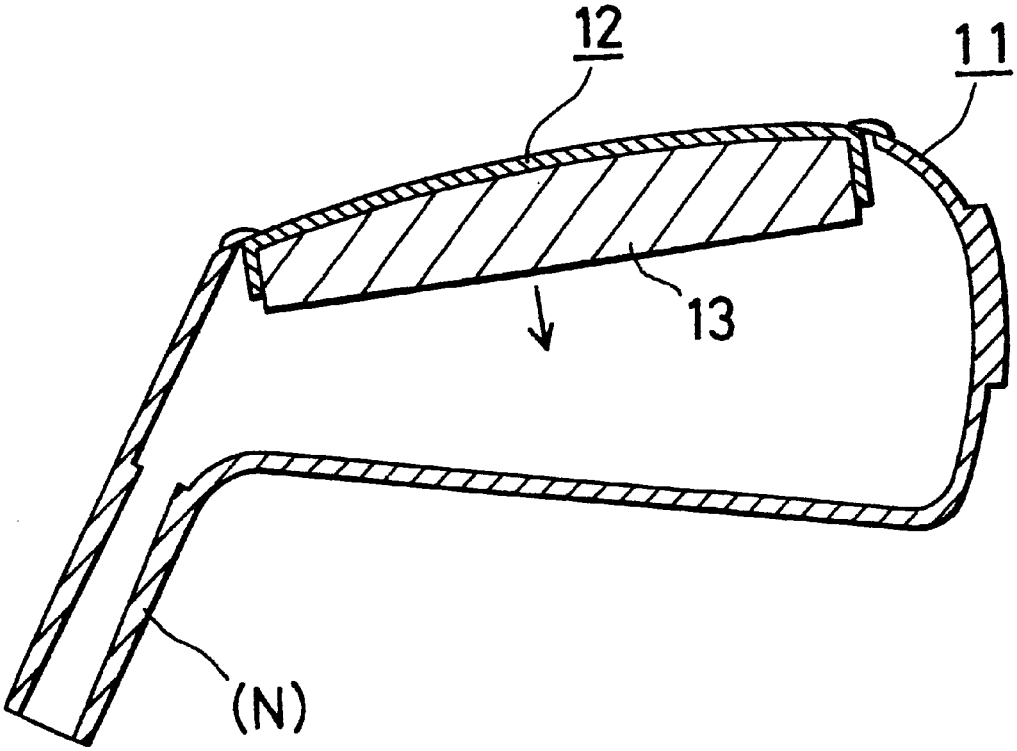
FIG. 8 is a vertical cross-sectional view of the hollow head body which is placed upside down for welding the sole member to the head body, wherein the sole member is fitted in the bottom opening of the hollow head body.
Figure 9:
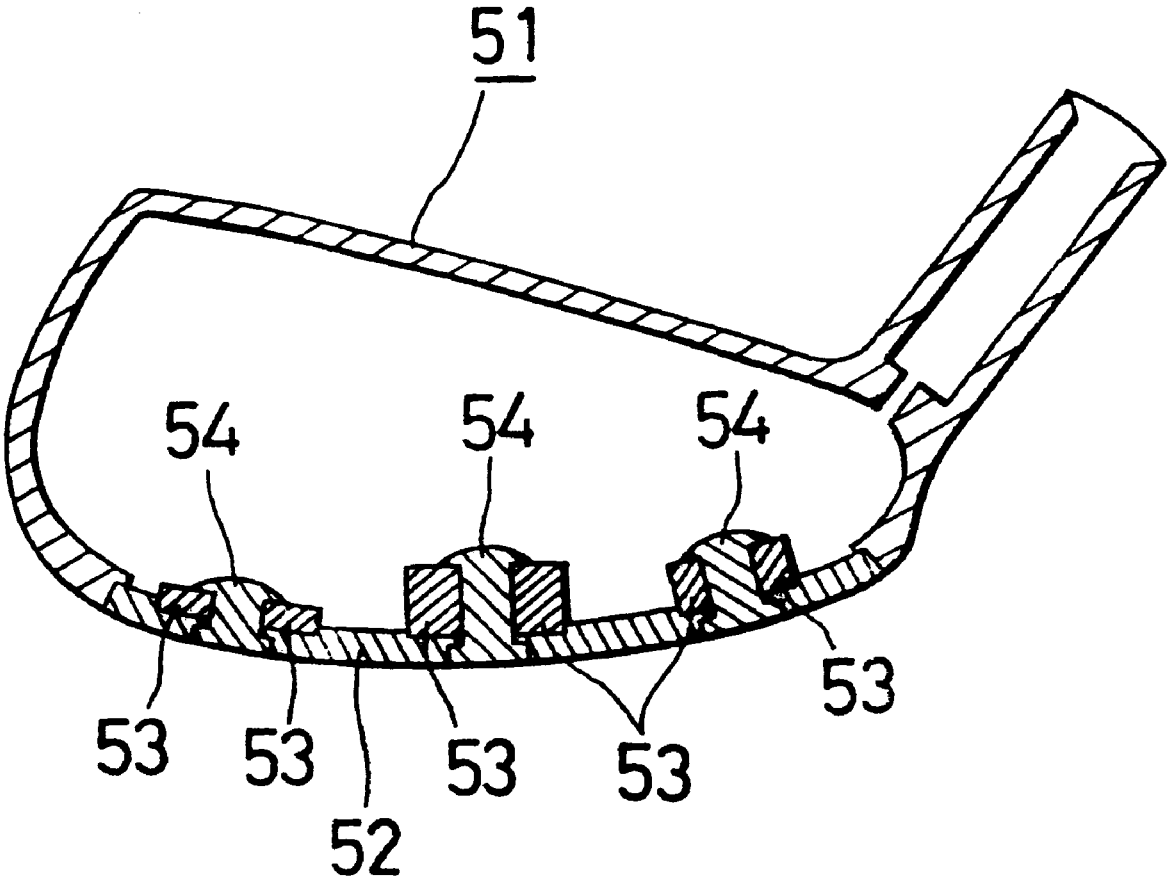
FIG. 9 is a cross-sectional view of a conventional metallic golf club head.

When firmly fixing the weight 3 in the concave portion 5 of the sole member 2, a shrink fitting process is preferably used. In a shrink fitting process, after the sole member 2 is heated to expand the concave portion 5, the weight 3 is fitted into the expanded concave portion 5. Then, the sole member 2 is cooled down to shrink the concave portion 5, thereby the weight 3 is firmly fixed in the concave portion 5 of the sole member 2 by a shrink fit. After the shrink fitting of the weight 3, the sole member 2 is welded to the head body 1. As shown in FIGS. 7 and 8, the welding can easily be performed in such a state that the head body 1 is placed upside down and the sole member 2 is fitted into the bottom opening 1*a* of the head body 1 with the outer surface of the sole member 2 facing down. However, when the sole member 2 is being welded to the head body 1 in this state, the sole member 2 is re-heated due to the welding heat, which causes the concave portion 5 to expand again. Then, the weight 3, which is fixed in the concave portion 5 by a shrink fit, may potentially slip downward as shown by the arrow in FIG. 8. Accordingly, if the weight 3 moves from the predetermined position in the concave portion 5 when the sole member 2 is being welded to the head body 1, the weight 3 can be fixed in the concave portion 5 at a wrong position. This results in a golf club head having a wrongly positioned center of gravity and an easy-to-loose weight. Therefore, when the sole member 2 with the weight 3 fitted therein is welded to the head body 1, it is necessary to avoid having the weight 3 move within the concave portion 5. For this reason, the protrusions 7, 8 of the sole member 2 are inserted, or anchored, in the weight 3 so that the weight 3 can be firmly secured to the sole member 2. Furthermore, the protrusions 7, 8 are effective not only when the weight 3 is secured in the concave portion 5 of the sole member 2 by a shrink fit but also when the weight 3 is just forcibly fitted into the concave portion 5 of the sole member 2.

A method of welding the sole member 2 with the weight 3 to the hollow head body will be explained as follows. As shown in FIG. 7, the hollow head body 1 is placed upside down. With the weight 3 faced down, the sole member 2 is fitted in the bottom opening 1*a* of the head body 1. The tongue-shaped small pieces 6 formed on the peripheral edge of the sole member 2 are engaged with the peripheral opening edge of the hollow head body 1, so that the sole member 2 is temporarily held in placed. Thus, a special tool for temporarily holding the sole member 2 is not required. Then, the peripheral portion of the sole member 2 is welded to the hollow head body 1. After welding, the golf club head will be completed by grinding or polishing over the surface including the welded portion.

In the above embodiment, both the hollow head body 1 and the sole member 2 are made of titanium, and the weight 3 is made of a metal other than titanium. However, the present invention is not limited to this. The sole member 2 and the weight 3 may be made of different metals which are difficult to be welded to each other.

In the above embodiment, the wall-like protrusions 7, 8 are formed on the inner bottom 5*a* of the concave portion 5, however, one or more short-length or pin-like protrusions may be formed on the inner bottom 5*a* instead of the wall-like protrusions 7, 8.

Furthermore, in the above embodiment, the present invention is applied to an iron club, but it can also be applied to a wood type golf club.

In the above embodiments, since wall-like protrusions 7, 8 are formed in the concave portion 5 of the sole member 2, the sole member 2 is reinforced by the protrusions which function as reinforcing ribs, resulting in an improved rigidity of the sole member 2.

This application claims priority to Japanese Patent Application No. H9-313842, filed on Nov. 14, 1997, the disclosure of its description, claims, drawings and abstract is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible which fall within the scope of the invention as claimed.

What is claimed is:

1. A metallic golf club head, comprising:

a hollow head body having a bottom opening;

a sole member fitted in said bottom opening; and a weight secured to said sole member, wherein said sole member includes an upwardly-opened weight-fitting concave portion having an inner bottom with at least one protrusion, wherein said weight is forcibly fitted in said concave portion and said at least one protrusion is forcibly inserted in a bottom of said weight, whereby said weight is firmly fixed in said concave portion, and wherein said sole member is welded to said hollow head body.

2. The metallic golf club head as recited in claim 1, wherein said hollow head body and sole member are made of titanium, and wherein said weight is made of a metallic material lower in hardness and larger in specific gravity than titanium.

3. The metallic golf club head as recited in claim 2, wherein said weight is made of a copper alloy.

4. The metallic golf club head as recited in claim 3, wherein said copper alloy is brass.

5. The metallic golf club head as recited in claim 2, wherein said weight is made of lead.

6. The metallic golf club head as recited in claim 1, wherein said protrusion has a wall-like shape.

7. The metallic golf club head as recited in claim 1, wherein said sole member includes a plurality of tongue-shaped small pieces protruding sideways from a peripheral portion of said sole member for engaging said sole member with a peripheral portion of said bottom opening.

8. The metallic golf club head as recited in claim 1, wherein a peripheral portion of said sole member is welded to said hollow head body.

9. The metallic golf club head as recited in claim 1, wherein said weight is secured in said concave portion by a shrink fit.

10. A method of manufacturing a metallic golf club head, which includes a hollow head body having a bottom opening, a sole member fitted in said bottom opening and welded to said hollow head body, and a weight secured to said sole member, the method including the steps of:

preparing a sole member made of a metallic material including an upwardly-opened weight-fitting concave portion which has an inner bottom with at least one protrusion;

heating said sole member to expand said concave portion;

fitting said weight into said expanded concave portion of said sole member and forcibly inserting said protrusion into a bottom of said weight;

cooling said concave portion to shrink-fit the weight in said concave portion;

fitting said sole member with said weight into said bottom opening of said hollow head body; and welding said sole member fitted in said bottom opening to said hollow head body.

11. The method of manufacturing a metallic golf club head as recited in claim 10, wherein said sole member includes a plurality of tongue-shaped small pieces protruding sideways from a peripheral portion of said sole member, and wherein said hollow head body is placed upside down, and said sole member is fitted into said bottom opening with said tongue-shaped small pieces engaged with a peripheral portion of said bottom opening.

* * * * *